US011976855B2

(12) United States Patent
Kim et al.

(10) Patent No.: US 11,976,855 B2
(45) Date of Patent: May 7, 2024

(54) HEAT EXCHANGER AND AIR CONDITIONER HAVING THE SAME

(71) Applicant: Samsung Electronics Co., Ltd., Suwon-si (KR)

(72) Inventors: Hyunyoung Kim, Yokohama (JP); Yo Agata, Yokohama (JP); Kentaro Imagawa, Yokohama (JP); Tadahiro Nakagawa, Yokohama (JP); Takeshi Takahara, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 165 days.

(21) Appl. No.: 17/098,015

(22) Filed: Nov. 13, 2020

(65) Prior Publication Data

US 2021/0140691 A1 May 13, 2021

(30) Foreign Application Priority Data

Nov. 13, 2019 (JP) ..... 2019-205712
Jul. 20, 2020 (JP) ..... 2020-123443
Oct. 12, 2020 (KR) ..... 10-2020-0130963

(51) Int. Cl.
*F25B 39/02* (2006.01)
*F25B 13/00* (2006.01)

(52) U.S. Cl.
CPC ..... *F25B 39/022* (2013.01); *F25B 13/00* (2013.01)

(58) Field of Classification Search
CPC ..... F25B 39/022; F25B 13/00; F28D 1/05391
See application file for complete search history.

(56) References Cited

U.S. PATENT DOCUMENTS 4,977,956 A * 12/1990 Aoki ..... F28D 1/05366 165/174
5,022,464 A * 6/1991 Aoki ..... F28F 9/0253 165/175

(Continued)

FOREIGN PATENT DOCUMENTS

JP H08-75310 A 3/1996
JP 2001133187 A * 5/2001 ..... F28D 1/0417

(Continued)

OTHER PUBLICATIONS

Condenser (heat transfer), Feb. 4, 2022, Wikipedia, p. 1, https://en.wikipedia.org/wiki/Condenser_(heat_transfer) (Year: 2022).*

(Continued)

*Primary Examiner* — Larry L Furdge
*Assistant Examiner* — Keith Stanley Myers

(57) ABSTRACT

A heat exchanger and an air conditioner including the same. The heat exchanger includes a plurality of heat transfer tubes formed in a flat shape and configured to allow a refrigerant to flow in a vertical direction therein. The heat transfer tube includes a gas refrigerant region including one end connected to a refrigerant inlet port and another end disposed above the refrigerant inlet port; a two-phase refrigerant region including one end connected to the other end of the gas refrigerant region and another end disposed below a refrigerant outlet port; and a liquid refrigerant region including one end connected to the other end of the two-phase refrigerant region and another end connected to the refrigerant outlet port.

20 Claims, 20 Drawing Sheets

(56) References Cited

U.S. PATENT DOCUMENTS

| | | | | |
|---|---|---|---|---|
| 9,696,094 | B2 | 7/2017 | Aoki et al. | |
| 10,247,482 | B2 * | 4/2019 | Gao | F28D 1/0233 |
| 2006/0191673 | A1 * | 8/2006 | Inaba | F28D 1/0333 62/515 |
| 2007/0144715 | A1 * | 6/2007 | Ohashi | F28D 1/05391 165/176 |
| 2011/0113823 | A1 * | 5/2011 | Joboji | F25B 39/022 62/515 |
| 2013/0284415 | A1 | 10/2013 | Katoh | |
| 2014/0124183 | A1 | 5/2014 | Hwang et al. | |
| 2014/0373570 | A1 * | 12/2014 | Moreau | F25B 39/022 62/515 |
| 2017/0105320 | A1 * | 4/2017 | Park | H05K 7/20254 |
| 2019/0048741 | A1 * | 2/2019 | Ishida | F01D 25/24 |

FOREIGN PATENT DOCUMENTS

| | | | | | |
|---|---|---|---|---|---|
| JP | 2010169289 | A | * | 8/2010 | F28D 1/047 |
| JP | 2018-179325 | A | | 11/2018 | |
| KR | 10-2014-0058321 | A | | 5/2014 | |
| KR | 10-2017-0080748 | A | | 7/2017 | |
| KR | 10-1867688 | B1 | | 6/2018 | |

OTHER PUBLICATIONS

International Search Report dated Feb. 25, 2021 in connection with International Patent Application No. PCT/KR2020/015754, 3 pages.

* cited by examiner

HEAT EXCHANGER AND AIR CONDITIONER HAVING THE SAME

CROSS-REFERENCE TO RELATED APPLICATIONS

This application is based on and claims priority under 35 U.S.C. 119 to Korean Patent Application No. 10-2020-0130963, filed on Oct. 12, 2020, in the Korean Intellectual Property Office, which claims the benefit of Japanese Patent Applications No. 2019-205712 filed on Nov. 13, 2019, and No. 2020-123443 filed on Jul. 20, 2020 in the Japan Patent Office, the disclosures of which are herein incorporated by reference in their entireties.

BACKGROUND

1. Field

The disclosure relates to a heat exchanger and an air conditioner including the same.

2. Description of Related Art

In recent year, in order to promote the refrigerant efficiency of air conditioners, a heat transfer tube of a heat exchanger has been smaller and as part of this, a multi-bored flat tube that is a flat tube member with multiple holes has been used as the heat transfer tube.

In a case in which a flat tube is installed horizontally and a heat exchanger serves as a condenser, water easily remains on a surface of a flat portion of the flat tube (particularly, an upper surface), and when a temperature drops, frost is formed on the flat tube caused by the remaining water, thereby disturbing air flow and deteriorating the performance of the heat exchanger.

Further, in addition to the above-described frost, another difficulty may occur as follows. When the heat transfer tube is installed horizontally, a header, to which a plurality of heat transfer tubes is connected, is arranged vertically and thus a liquid refrigerant is easily collected in a lower portion of the header. Accordingly, a complicated distribution device may be required to distribute an appropriate amount of refrigerant to each heat transfer tube.

As disclosed in patent document 1, when a heat transfer tube is installed vertically, moisture adhering to the surface of the flat tube flows off, and thus the above-described difficulty related to frost is alleviated. Further, because the header is arranged horizontally, the liquid refrigerant in the header smoothly flows into each heat transfer tube and thus the above-described difficulty in a distribution device is alleviated.

However, when the heat transfer tube is installed vertically and the refrigerant flowing in the heat transfer tube becomes a gas-liquid two phase state, the liquid refrigerant is collected in the lower portion of the heat transfer tube due to the gravity caused by a difference in density of the gas-liquid refrigerant and thus the gas refrigerant may not push the collected liquid refrigerant. Therefore, the gas refrigerant flowing in the header flows to a heat transfer tube in which the gas refrigerant is not collected, and thus it may cause non-uniformity of a heat transfer region, thereby deteriorating the performance of the entire heat exchanger.

RELATED ART DOCUMENT (Patent Document 1) Japanese Patent Publication No. 2018-179325

SUMMARY

Therefore, it is an aspect of the disclosure to provide a heat exchanger capable of preventing non-uniformity of a heat transfer region caused by a liquid refrigerant that is collected in a lower portion of a heat transfer tube upon installing the heat transfer tube vertically, and an air conditioner including the same.

Additional aspects of the disclosure will be set forth in part in the description which follows and, in part, will be obvious from the description, or may be learned by practice of the disclosure.

In accordance with an aspect of the disclosure, a heat exchanger includes a plurality of heat transfer tubes formed in a flat shape and configured to change a high temperature gas refrigerant, which is introduced from a refrigerant inlet port, into a low temperature liquid refrigerant and discharge the low temperature liquid refrigerant through a refrigerant outlet port. The heat transfer tube includes a gas refrigerant region provided in such a way that one end is connected to the refrigerant inlet port and at the same time, the other end is disposed above the refrigerant inlet port, a two-phase refrigerant region provided in such a way that one end is connected to the other end of the gas refrigerant region and at the same time the other end is disposed below the refrigerant outlet port, and a liquid refrigerant region provided in such a way that one end is connected to the other end of the two-phase refrigerant region and at the same time, the other end is connected to the refrigerant outlet port.

In the heat exchanger, the liquid refrigerant may flow downward in the two-phase refrigerant region and flow into the liquid refrigerant region with the momentum, and then may be discharged through the refrigerant outlet port. Further, because the gas refrigerant flows downward in the same direction as the liquid refrigerant in the two-phase refrigerant region, the gas refrigerant may flow without pushing up the liquid refrigerant.

As a result, the heat exchanger may allow the refrigerant to flow in a vertical direction, thereby alleviating a difficulty related to frost and a distribution device caused by the heat transfer tube being installed horizontally, and thereby preventing non-uniformity of the heat transfer region caused by the liquid refrigerant that is collected in a lower portion of the heat transfer tub.

The vertical direction may not necessarily have to be a direction along the vertical direction, and for example, the vertical direction may include a direction inclined from the vertical direction as long as allowing water collected on a surface (particularly, an upper surface) of the flat-shaped heat transfer tube to flow.

In order to reduce an amount of refrigerant consumption, it is appropriate that the gas refrigerant region, the two-phase refrigerant region, and the liquid refrigerant region may be each formed of a first multi-bored flat tube, a second multi-bored flat tube, and a third multi-bored flat tube.

In order to facilitate assembly of the first to third multi-bored flat tubes, it is appropriate to further include an upper header configured to allow the gas refrigerant region to communicate with the two-phase refrigerant region by connecting the other end of the gas refrigerant region to the one end of the two-phase refrigerant region, and a lower header configured to allow the two-phase refrigerant region to communicate with the liquid refrigerant region by connecting the other end of the two-phase refrigerant region to the one end of the liquid refrigerant region.

It is appropriate that the plurality of heat transfer tubes is connected to the upper header and the lower header, and an inside of at least one of the upper header or the lower header is divided into a plurality of spaces corresponding to the plurality of heat transfer tubes.

It is possible to prevent the refrigerant flowing through the plurality of heat transfer tubes from being mixed with each other in the inside of the upper header and the lower header and thus there is no need to divide the refrigerant flowing into the upper header and the lower header.

The heat transfer tube may be provided by bending one multi-bored flat tube. Accordingly, the upper header or lower header may not be required, and thus the number of parts may be reduced.

In a configuration in which air flows between the plurality of heat transfer tubes, an inlet header to which the inlet port of the plurality of heat transfer tubes is connected, and an outlet header to which the outlet port of the plurality of heat transfer tubes is connected may be further provided, and it is appropriate that the inlet header and the outlet header are disposed on a leeward side in the two-phase refrigerant region.

In this configuration, because the heat exchange is performed more efficiently in the two-phase refrigerant region than the gas refrigerant region or the liquid refrigerant region, all or most of the gas refrigerant may be changed into the liquid refrigerant before reaching the liquid refrigerant region while suppressing the refrigerant from being liquefied in the gas refrigerant region.

It is appropriate that a shape of the heat transfer tube is different from each other in at least two of the gas refrigerant region, the two-phase refrigerant region, and the liquid refrigerant region.

The liquid refrigerant region may have a smaller volume than the gas refrigerant region, and thus, by reducing a size of the heat transfer tube in the liquid refrigerant region than a size of the heat transfer tube in the gas refrigerant region, it is possible to reduce the cost.

In accordance with another aspect of the disclosure, a heat exchanger includes a plurality of heat transfer tubes formed in a flat shape and configured to change a high temperature gas refrigerant, which is introduced from a refrigerant inlet port, into a low temperature liquid refrigerant and discharge the low temperature liquid refrigerant through a refrigerant outlet port. The heat transfer tube includes a gas refrigerant region provided in such a way that one end is connected to the refrigerant inlet port and at the same time, the other end is disposed above the refrigerant inlet port, and a two-phase refrigerant region provided in such a way that one end is connected to the other end of the gas refrigerant region and at the same time, the other end is connected to the refrigerant outlet port.

In the heat exchanger, the liquid refrigerant may flow downward in the two-phase refrigerant region and may be discharged through the refrigerant outlet port. Further, because the gas refrigerant flows downward in the same direction as the liquid refrigerant in the two-phase refrigerant region, the gas refrigerant may flow without pushing up the liquid refrigerant.

As a result, the heat exchanger may allow the refrigerant to flow in a vertical direction, thereby alleviating a difficulty related to frost and a distribution device caused by the heat transfer tube being installed horizontally, and thereby preventing non-uniformity of the heat transfer region caused by the liquid refrigerant that is collected in a lower portion of the heat transfer tub.

The heat exchanger may not need the liquid refrigerant region in comparison with the configuration including three regions such as the gas refrigerant region, the two-phase refrigerant region, and the liquid refrigerant region, and thus it is possible to reduce the cost as much as the cost of the liquid refrigerant region.

In order to prevent the liquid refrigerant from falling due to gravity in the gas refrigerant region, it is appropriate that the liquid refrigerant region is 7% or more and 25% or less of the length of the heat transfer tube.

In order to ensure high heat exchange efficiency, it is appropriate that the gas refrigerant region is 25% or more and 43% or less of the length of the heat transfer tube.

Data showing such an effect will be described later.

The air conditioner according to the disclosure may include the heat exchanger, and the above-described effect may be achieved also by the air conditioner.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter an embodiment of a heat exchanger according to the disclosure will be described in detail with reference to the accompanying drawings.

Figure 1:
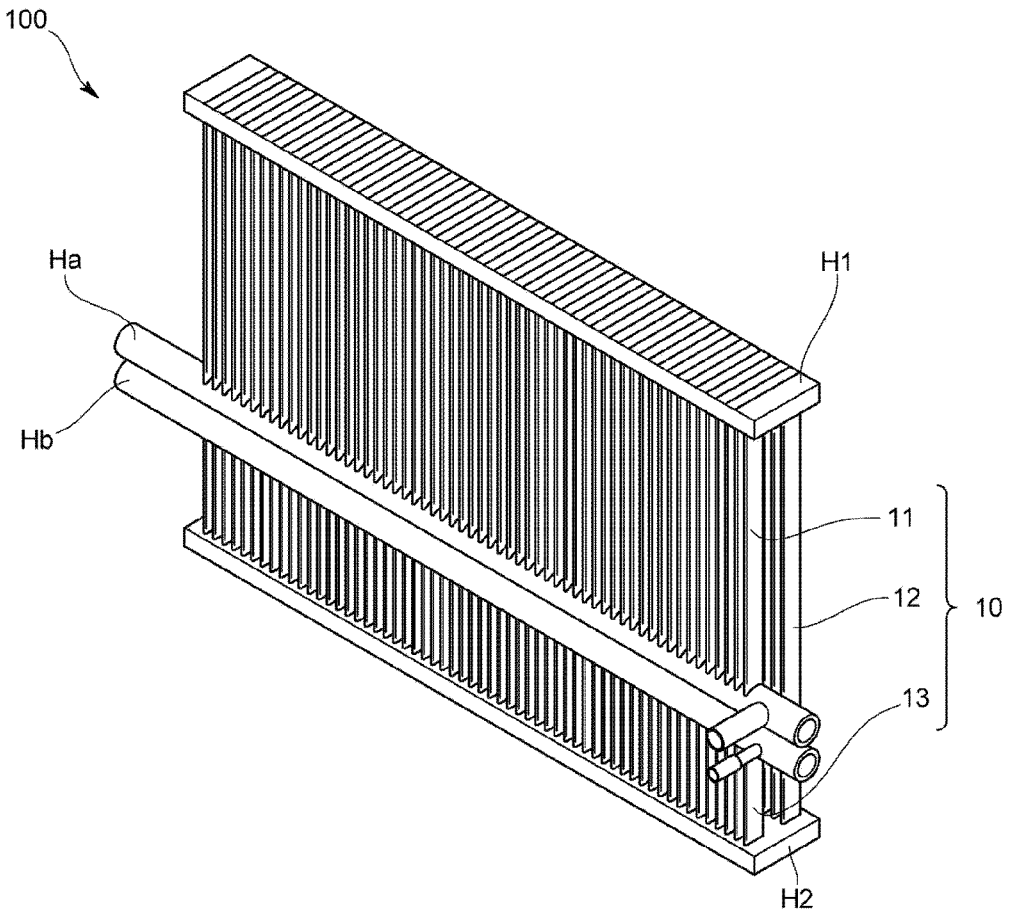
FIG. 1 illustrates a perspective view of an overall configuration of a heat exchanger according to an embodiment of the disclosure.

Particularly, as shown in FIG. 1, a heat exchanger 100 includes a plurality of heat transfer tubes 10 arranged to allow a refrigerant to flow in a vertical direction therein, an inlet header Ha configured to introduce a high temperature gas liquid refrigerant into the heat transfer tube 10, and an outlet header Hb configured to discharge a low temperature liquid refrigerant from the heat transfer tube 10.

The plurality of heat transfer tubes 10 is arranged at a predetermined distance along a horizontal direction so as to be parallel to each other, and each heat transfer tube 10 stands in the vertical direction. A fin is mounted on an outer circumferential surface of the heat transfer tube 10 so as to perform heat exchange between air flowing between the fins, and the refrigerant flowing through an internal flow path of the heat transfer tube 10.

Figure 2A:
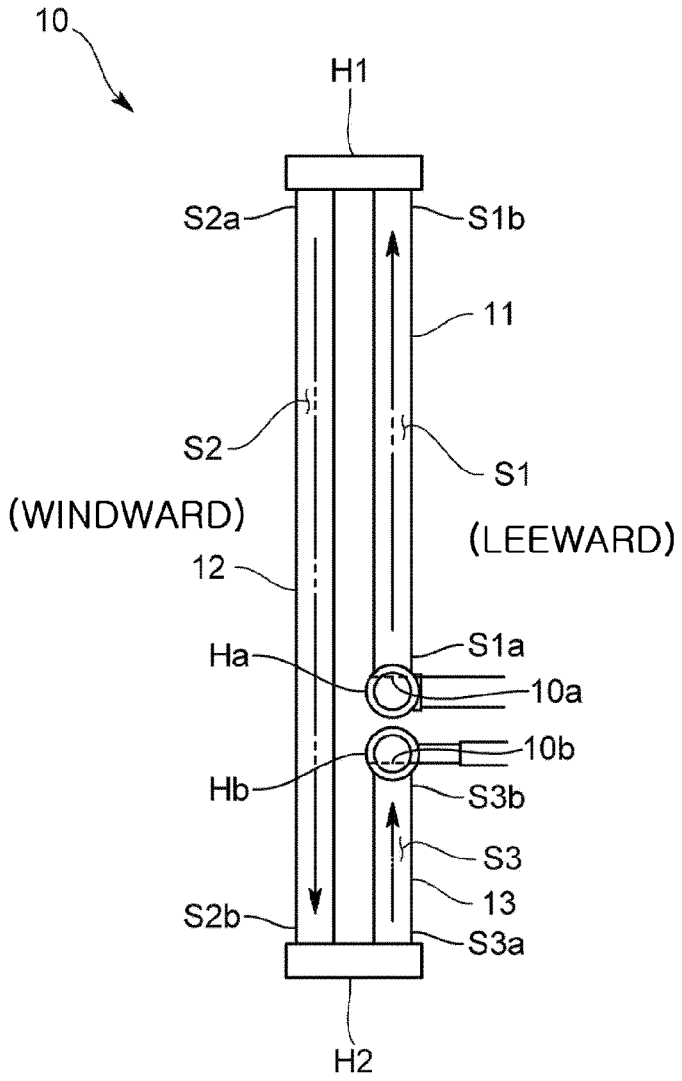
FIG. 2A is a view illustrating a configuration of a heat transfer tube according to an embodiment of the disclosure.
Figure 2B:
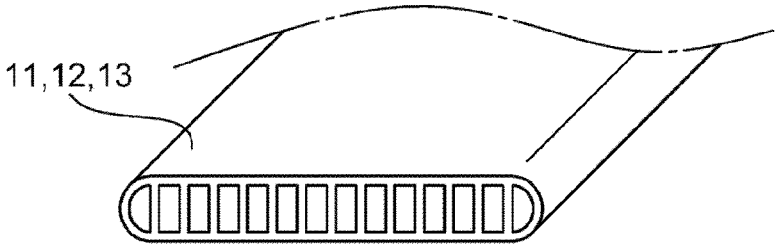
FIG. 2B is a view illustrating the configuration of the heat transfer tube according to an embodiment of the disclosure.

As shown in FIGS. 2A and 2B, each heat transfer tube 10 is formed in a substantially C shape forming an annular refrigerant flow path through which the refrigerant flows, and the heat transfer tube 10 includes a refrigerant inlet port 10*a* to which the inlet header Ha is connected, and a refrigerant outlet port 10*b* to which the outlet header Hb is connected. Therefore, a high-temperature gas refrigerant introduced from the refrigerant inlet port 10*a* may be changed into a low-temperature liquid refrigerant, and then discharged to the refrigerant outlet port 10*b*. The refrigerant inlet port 10*a* is disposed above the refrigerant outlet port 10*b*, but the arrangement of the refrigerant inlet port 10*a* and the refrigerant outlet port 10*b* may be appropriately changed.

The heat transfer tube 10 is composed of one or a plurality of flat tubes, and according to the embodiment, the heat transfer tube 10 is formed with two rows of multi-board flat tube, in which a plurality of internal flow paths is formed, more particularly, three rows of multi-bored flat tube 11~13, as shown in FIGS. 1, 2A and 2B.

In addition, as shown in FIGS. 2A and 2B, the heat transfer tube 10 according to the embodiment includes a gas refrigerant region S1 in which the introduced gas refrigerant flows upward, and a two-phase refrigerant region S2 in which a gas-liquid two phase refrigerant flows downward at a downstream side of the gas refrigerant region S1, and a liquid refrigerant region S3 in which a liquid refrigerant flows upward at a downstream side of the two-phase refrigerant region S2.

The gas refrigerant region S1 is formed by an internal flow path of one of the three multi-bored flat tubes 11~13 (hereinafter referred to as "first multi-bored flat tube 11"), and the gas refrigerant region S1 is a region that is set to allow one end side S1*a* to be connected to the refrigerant inlet port 10*a* and at the same time, to allow the other side S1*b* to be arranged above the refrigerant inlet port 10*a*.

The two-phase refrigerant region S2 is formed by an internal flow path of one of the three multi-bored flat tubes 11~13 (hereinafter referred to as "second multi-bored flat tube 12"), and the two-phase refrigerant region S2 is a region that is set to allow one end side S2*a* to be connected to the other side S1*b* of the gas refrigerant region S1 and at the same time, to allow the other side S2*b* to be arranged below the refrigerant outlet port 10*b*.

The liquid refrigerant region S3 is formed by an internal flow path of one of the three multi-bored flat tubes 11~13 (hereinafter referred to as "third multi-bored flat tube 13"), and the liquid refrigerant region S3 is a region that is set to allow one end side S3*a* to be connected to the other side S2*b* of the two-phase refrigerant region S2 and at the same time, to allow the other side S3*b* to be connected to the refrigerant outlet port 10*b*.

As shown in FIGS. 1, 2A and 2B, an upper end side of the first multi-bored flat tube 11 and an upper end side of the second multi-bored flat tube 12 are connected to an upper header H1. That is, the upper header H1 connects the other end S1*b* of the gas refrigerant region S1 to the one end S2*a* of the two-phase refrigerant region S2 so as to allow the gas refrigerant region S1 to communicate with the two-phase refrigerant region S2.

Further, a lower end side of the second multi-bored flat tube 12 and a lower end side of the third multi-bored flat tube 13 are connected to a lower header H2. That is, the lower header H2 connects the other end S2*b* of the two-phase refrigerant region S2 to the one end S3*a* of the liquid refrigerant region S3 so as to allow the two-phase refrigerant region S2 to communicate with the liquid refrigerant region S3.

In the inside of the upper header H1 and the lower header H2, a plurality of partition plates is provided along an extension direction of the headers H1 and H2. The inside of the upper header H1 and the lower header H2 is divided into a plurality of inner spaces by the partition plate. A single heat transfer tube 10 is connected in a single inner space. That is, in each inner space of the upper header H1, the upper end side of the single first multi-bored flat tube 11 is connected to the upper end side of the single second multi-bored flat tube 12, and in each inner space of the lower header H2, the lower end side of the single second multi-bored flat tube 12 is connected to the lower end side of the single third multi-bored flat tube 13.

According to the embodiment, as shown in FIGS. 2A and 2B, the first multi-bored flat tube 11 and the third multi-bored flat tube 13 are disposed on the leeward side than the second multi-bored flat tube 12. In other words, the gas refrigerant region S1 and the liquid refrigerant region S3 are disposed on the leeward side than the two-phase refrigerant region S2. As a result, it is possible to promote heat exchange when the refrigerant passes through the two-phase refrigerant region S2, and thus the gas refrigerant as much as possible is changed into the liquid refrigerant in the two-phase refrigerant region S2 while preventing the refrigerant from becoming the two-phase refrigerant as much as possible in the gas refrigerant region S1.

However, a refrigerant in a process, in which the refrigerant is changed from a gas state to a liquid state, is transited in states such as single phase vapor flow, annular-mist flow, annular flow, semi-annular flow, slug flow, plug flow, and single phase liquid flow. Among states in which the gas refrigerant and the liquid refrigerant are mixed, a state for transporting a liquid refrigerant together with a gas refrigerant is up to the annular flow, and thus a dryness fraction (or quality) may be 0.75 or more that is a limit of the annular flow.

Figure 3:
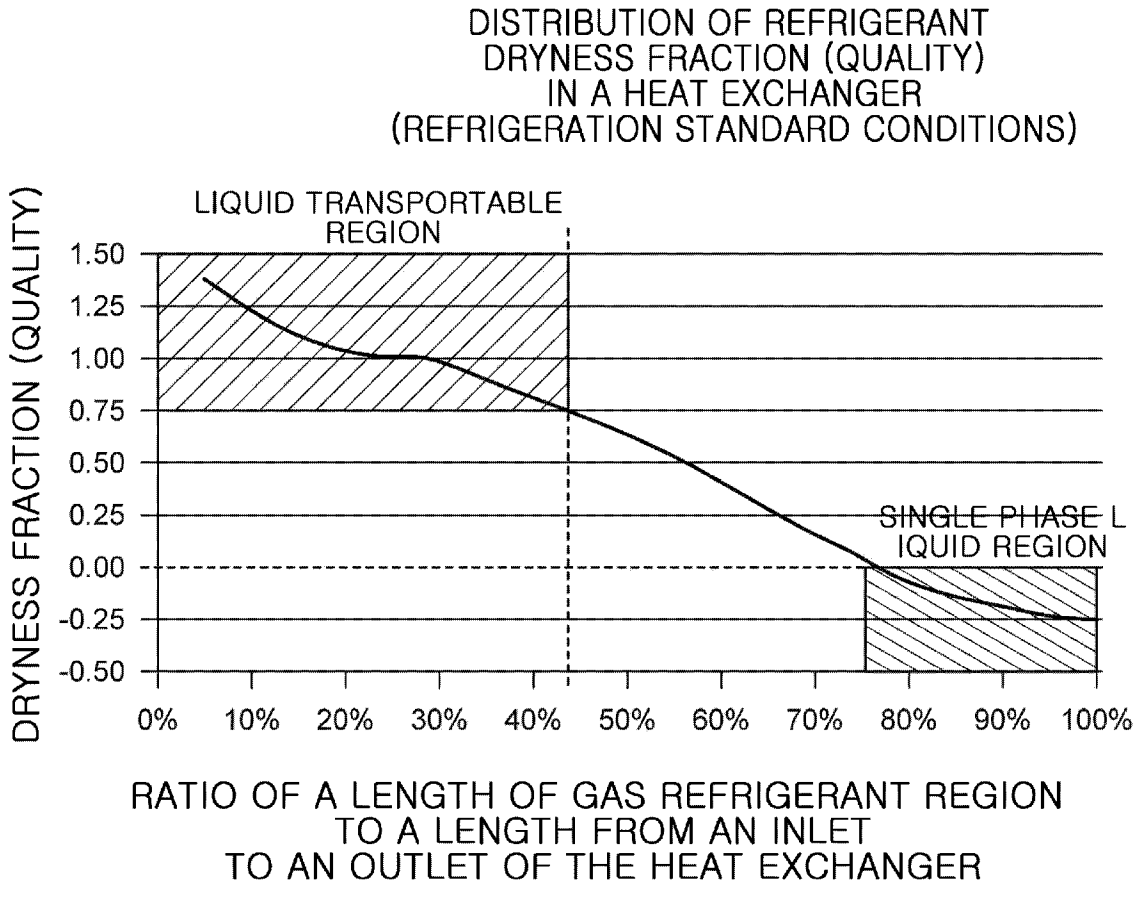
FIG. 3 is a correlation diagram illustrating a correlation between a length of a gas refrigerant region and a dryness fraction (or quality) according to an embodiment of the disclosure.

A correlation diagram shown in FIG. 3 illustrates a correlation between a length from the refrigerant inlet port 10*a* to the refrigerant outlet port 10*b*, that is, the ratio of the length of the gas refrigerant region S1 to the total length of the heat transfer tube 10 (a length of the heat exchange effective part) and a dryness fraction (or quality).

Based on this correlation, in order to transport the liquid refrigerant by the gas refrigerant in the gas refrigerant region S1, the gas refrigerant region S1 is set to be 43% or less of the length of the heat transfer tube 10 to make a dryness fraction (or quality) of the refrigerant to be 0.75 or more in the gas refrigerant region S1. In response to the length of the gas refrigerant region S1 being greater than 43% of the length of the heat transfer tube 10, the liquid refrigerant falls by gravity and then is collected in the lower portion of the gas refrigerant region S1.

Further, the liquid refrigerant region S3 is set to be 25% or less of the length from the refrigerant inlet port 10*a* to the refrigerant outlet port 10*b*, that is, the total length of the heat transfer tube 10 (the length of the heat exchange effective part). This is, in response to the length of the liquid refrigerant region S3 being 25% or less of the total length of the heat transfer tube 10, the gas-liquid two-phase refrigerant may not flow into the liquid refrigerant region S3, and thus the entire liquid refrigerant region S3 may be filled with the liquid refrigerant, thereby securing the high heat exchange efficiency.

Figure 4A:
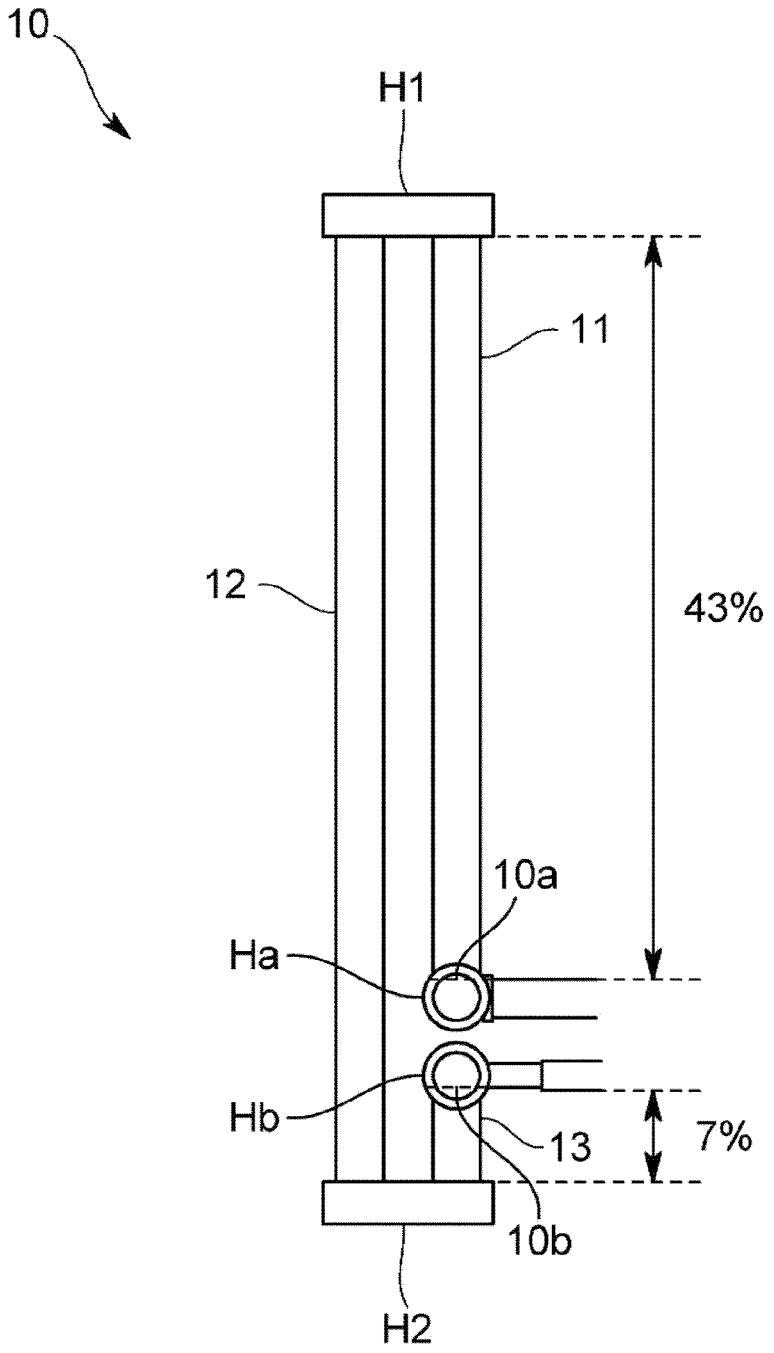
FIG. 4A is a view illustrating a range of value taken by the length of the gas refrigerant region according to an embodiment of the disclosure.
Figure 4B:
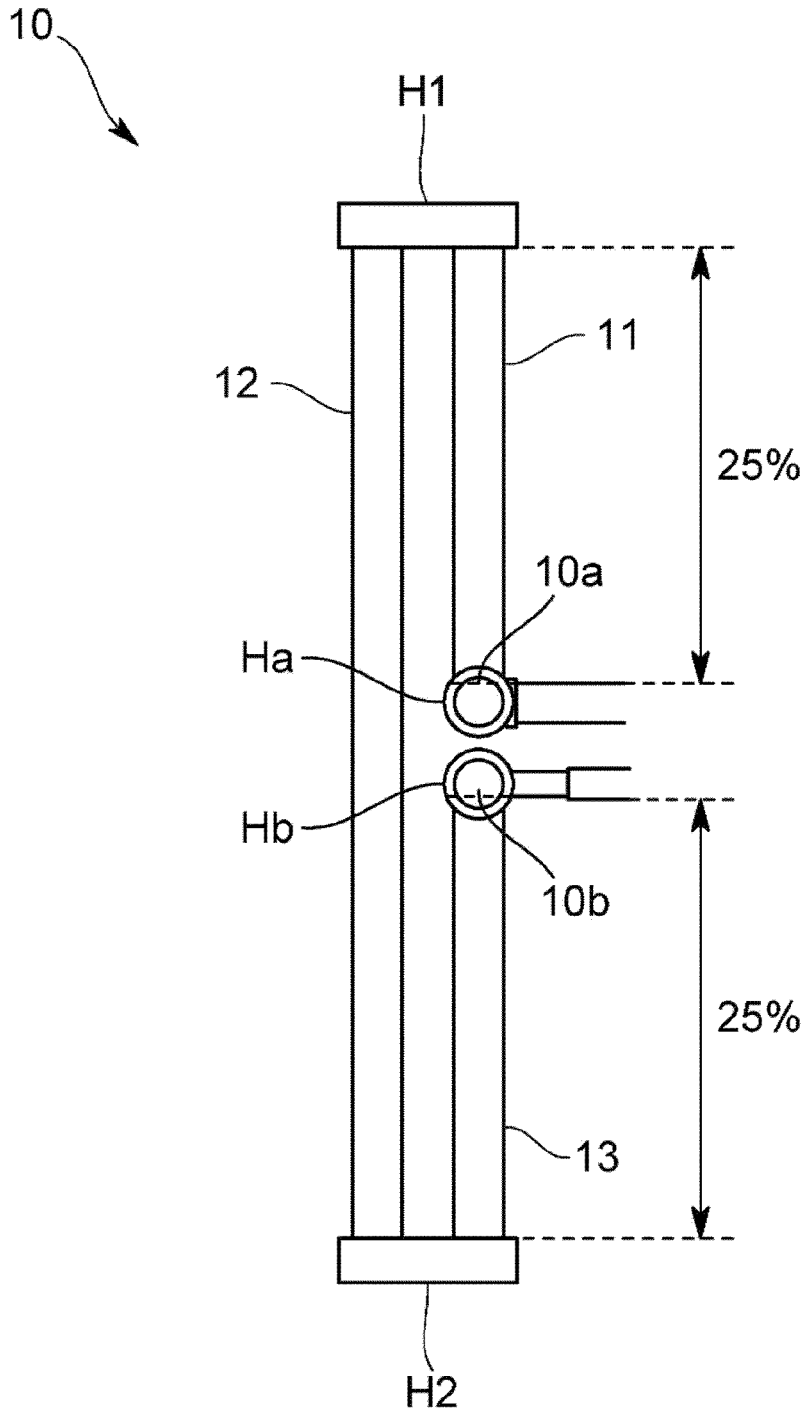
FIG. 4B is a view illustrating the range of value taken by the length of the gas refrigerant region according to an embodiment of the disclosure.

Accordingly, as for the heat transfer tube 10, it is appropriate that the gas refrigerant region S1 is 25% or more and 43% or less of the total length of the heat transfer tube 10, and the liquid refrigerant region S3 is 7% or more and 25% or less of the total length of the heat transfer tube 10, as shown in FIGS. 4A and 4B.

In the heat exchanger 100 configured as described above, the liquid refrigerant flows downward in two-phase refrigerant region S2 and flows into the liquid refrigerant region S3 with the momentum, and then is discharged through the refrigerant outlet port 10*b*. Further, because the gas refrigerant flows downward in the same direction as the liquid refrigerant in the two-phase refrigerant region S2, the gas refrigerant may flow without pushing up the liquid refrigerant.

As a result, the heat exchanger 100 according to the embodiment may allow the refrigerant to flow in the vertical direction, thereby alleviating the difficulty related to the frost and the distribution device caused by the heat transfer tube 10 being installed horizontally, and thereby preventing non-uniformity of the heat transfer region caused by the liquid refrigerant that is collected in the lower portion of the heat transfer tube 10.

In addition, because the gas refrigerant region S1, the two-phase refrigerant region S2, and the liquid refrigerant region S3 are each formed with the multi-bored flat tube, it is possible to reduce an amount of refrigerant consumption.

Further, because the inside of the upper header H1 and the lower header H2 is divided into the plurality of spaces corresponding to the plurality of heat transfer tubes 10, the refrigerant flowing through the plurality of heat transfer tubes 10 may not be mixed with each other in the inside of the upper header H1 and the lower header H2 and thus there is no need to divide the refrigerant flowing into the upper header H1 and the lower header H2.

When the inlet header Ha and the outlet header Hb are arranged in the heat exchange effective part between the upper header H1 and the lower header H2 as shown in the embodiment, an increase in the ventilation resistance or a decrease in the heat exchange capacity caused by the inlet header Ha and the outlet header Hb may be concerned. However, according to the analysis results, ventilation resistance is +0.1% and heat exchange capacity is −1.4%, and it has little effect on the performance of the heat exchanger 100.

The disclosure is not limited to the above embodiment.

Figure 5A:
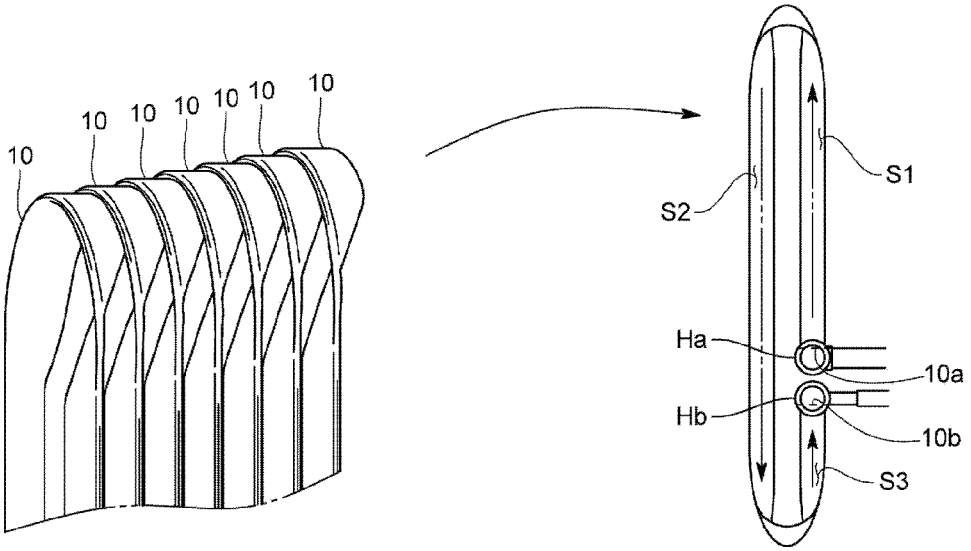
FIG. 5A is a view illustrating a configuration of a heat transfer tube according to another embodiment of the disclosure.
Figure 5B:
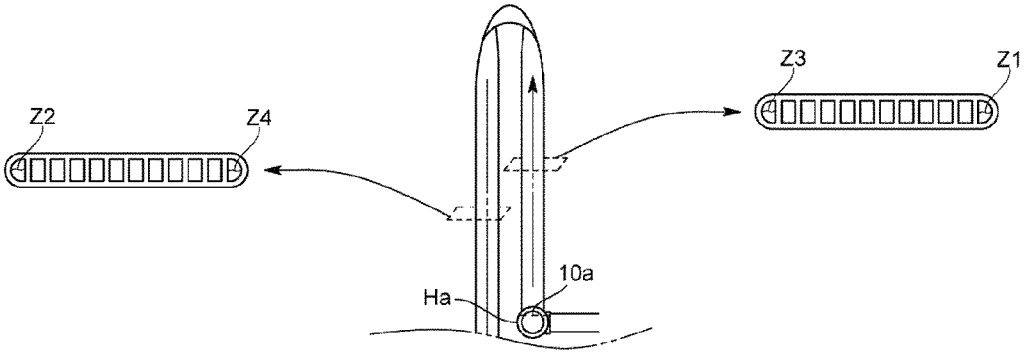
FIG. 5B is a view illustrating the configuration of the heat transfer tube according to another embodiment of the disclosure.

For example, the heat transfer tube 10 according to the above embodiment includes three flat tubes 11 to 13, but the heat transfer tube 10 may include a single flat tube, as shown in FIGS. 5A and 5B. Particularly, the heat transfer tube 10 may be formed by bending one multi-bored flat tube in an annular shape, and accordingly, the upper header H1 and the lower header H2 of the above embodiment may be not required.

In addition, in the case of the heat transfer tube 10 shown in FIGS. 5A and 5B, a leeward side gas flow path Z1 placed in the leeward side in the gas refrigerant region S1 is folded and then becomes a windward side two-phase flow path Z2 in the leeward side of the two-phase refrigerant region S2. A windward side gas flow path Z3 placed in the windward side in the gas refrigerant region S1 is folded and then becomes a windward side two-phase flow path Z4 in the leeward side of the two-phase refrigerant region S2. Accordingly, the refrigerant flowing through each of the internal flow paths of the heat transfer tube 10 may be heat-exchanged more uniformly, and the heat transfer tube may perform more effective heat exchange.

Figure 6:
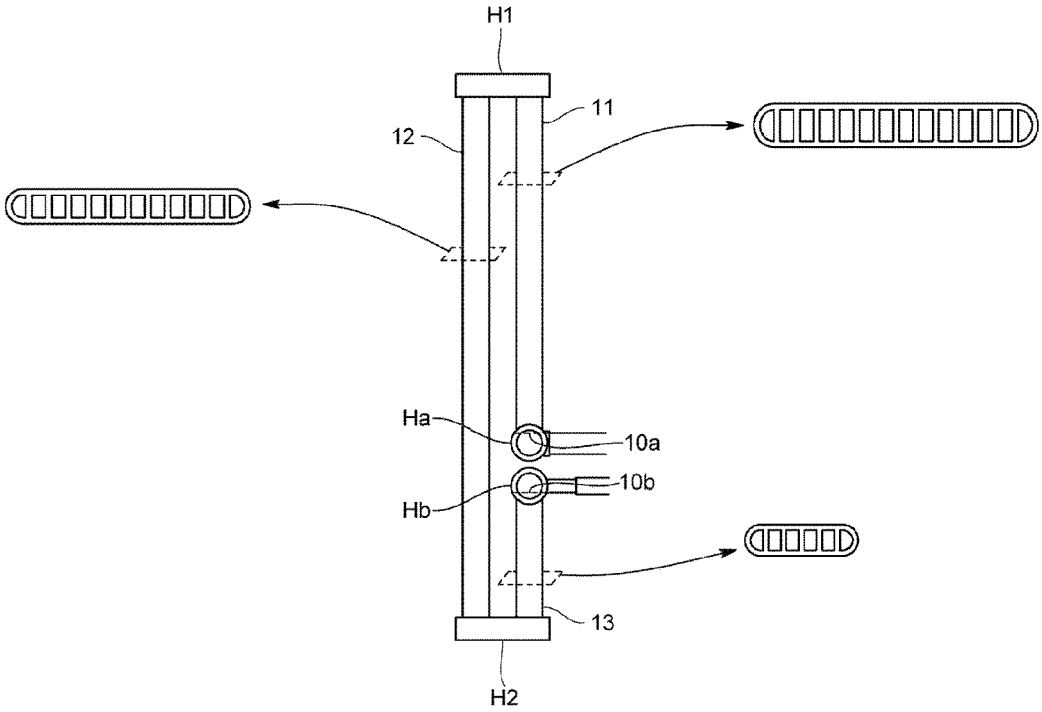
FIG. 6 is a view illustrating a configuration of a heat transfer tube according to another embodiment of the disclosure.

In addition, the heat transfer tube 10 may have a different shape in at least two of the gas refrigerant region S1, the two-phase refrigerant region S2, and the liquid refrigerant region S3, as shown in FIG. 6.

More particularly, because according to the state of the solvent flowing thereon, a volume of the heat transfer tube 10 decreases from the liquid refrigerant region S3, the two-phase refrigerant region S2, to the gas refrigerant region S1, it is appropriate that a volume of the multi-bored flat tube (internal flow path) forming each regions S1~S3 is gradually reduced from the liquid refrigerant region S3, the two-phase refrigerant region S2, to the gas refrigerant region S1. According to various embodiments, a width, a thickness, the number of holes, a size of hole, etc. of the multi-bored flat tube forming the each regions S1 to S3 are different from each other.

By the above-mentioned configuration, it is not required to increase the size of the heat transfer tube 10 more than necessary, and thus it is possible to reduce cost.

Figure 7A:
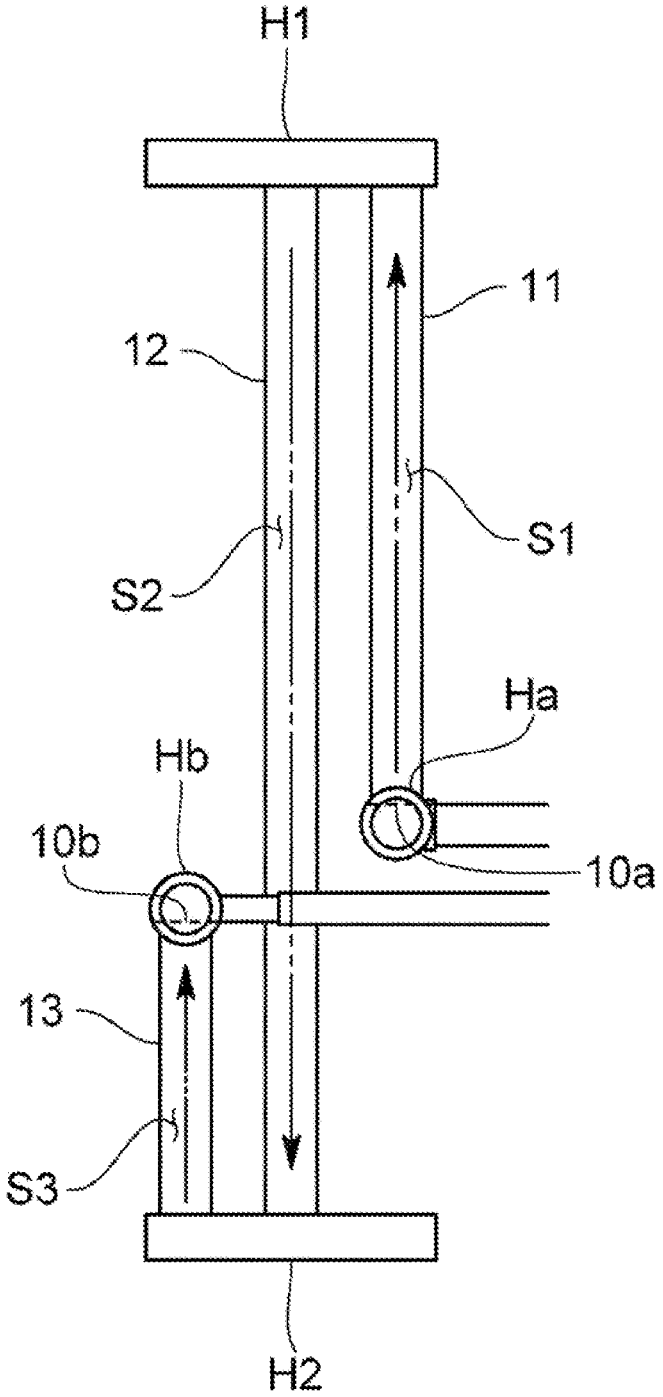
FIG. 7A is a view illustrating a configuration of a heat transfer tube according to another embodiment of the disclosure.
Figure 7B:
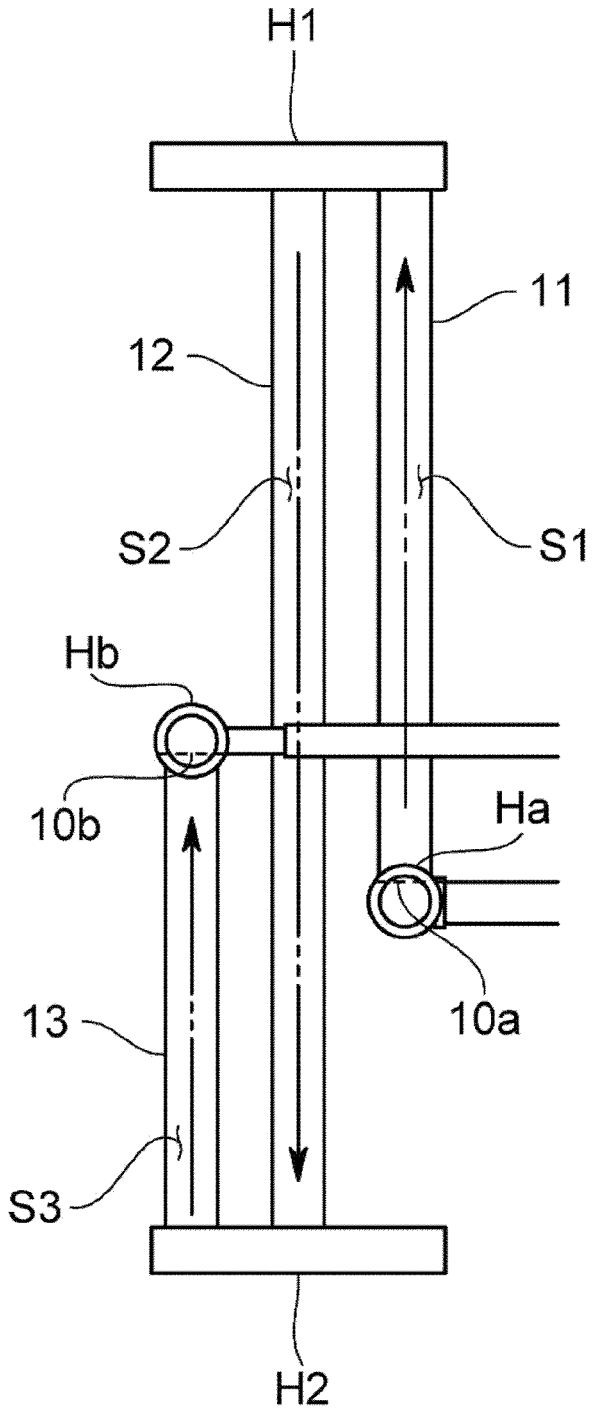
FIG. 7B is a view illustrating the configuration of the heat transfer tube according to another embodiment of the disclosure.

According to the embodiment, the two-phase refrigerant region S2 is arranged on the windward side than the gas refrigerant region S1 and the liquid refrigerant region S3, but is not limited thereto. Alternatively, the two-phase refrigerant region S2 may be arranged between the gas refrigerant region S1 and the liquid refrigerant region S3, as shown in FIGS. 7A and 7B. Alternatively, an upstream side of the two-phase refrigerant region S2 may be arranged above the liquid refrigerant region S3 and at the same time, a downstream side of the two-phase refrigerant region S2 may be obliquely extended from the upstream side and arranged below the gas refrigerant region S1.

In addition, according to the embodiment, the refrigerant inlet port 10*a* of the heat transfer tube 10 is arranged above the refrigerant outlet port 10*b*. Alternatively, the refrigerant inlet port 10*a* may be disposed below the refrigerant outlet port 10*b*, as shown in FIG. 7B.

Figure 8:
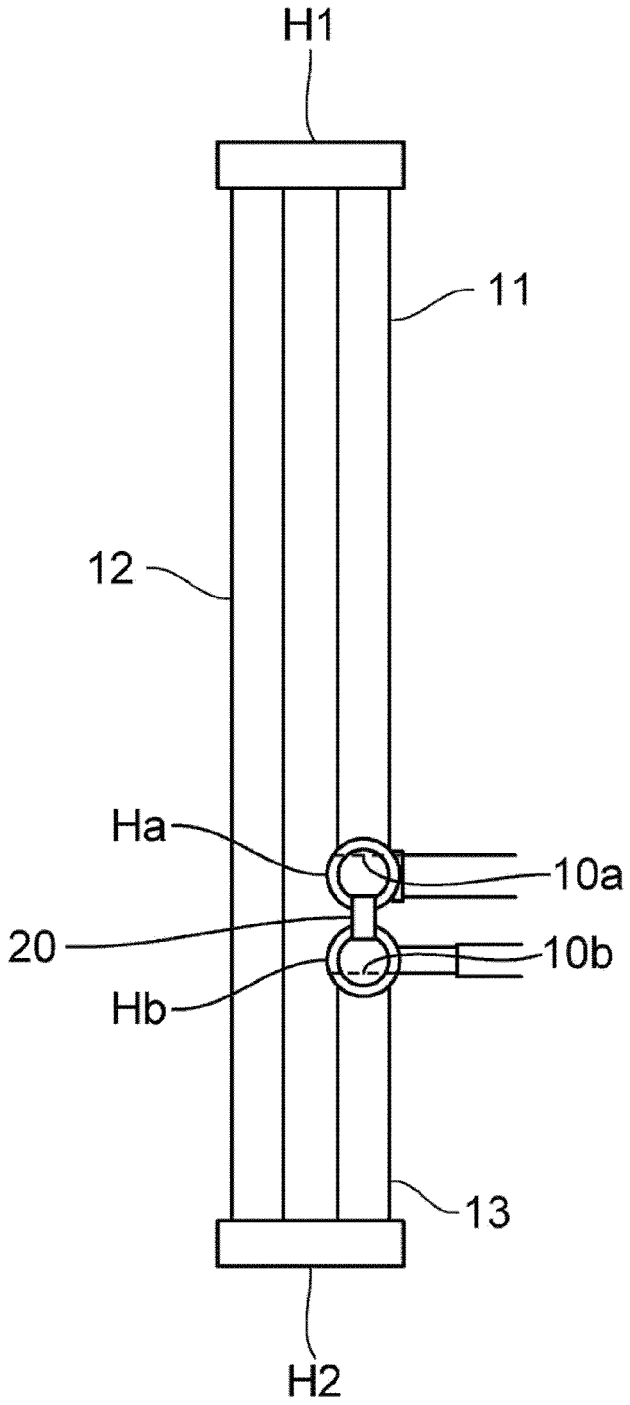
FIG. 8 is a view illustrating a configuration of a heat transfer tube according to another embodiment of the disclosure.

In addition, as shown in FIG. 8, a gap between the inlet header Ha and the outlet header Hb may be filled with a heat insulating material 20 such as a resin member or a foam material.

Because the gap between the inlet header Ha and the outlet header Hb is not filled with the refrigerant and the space does not contribute to the heat exchange, the above-mentioned configuration may prevent air from flowing in the gap. Therefore, it is possible to increase a volume of air flowing to a region that contributes the thermal efficiency, thereby increasing the heat exchange efficiency more.

In addition, in the heat exchanger 100 according to the embodiment, the liquid refrigerant region S3 may not be installed in the heat transfer tube 10. That is, as shown in FIG. 9, a heat transfer tube 10 including a gas refrigerant region S1 provided in such a way that one end thereof is connected to the refrigerant inlet port 10*a* and the other end thereof is disposed above the refrigerant inlet port 10*a*, and a two-phase refrigerant region S2 provided in such a way that one end thereof is connected to the other end of the gas refrigerant region S1 and the other thereof is connected to the refrigerant outlet port 10*b* may be described as an example of the heat exchanger according to the disclosure.

Figure 9:
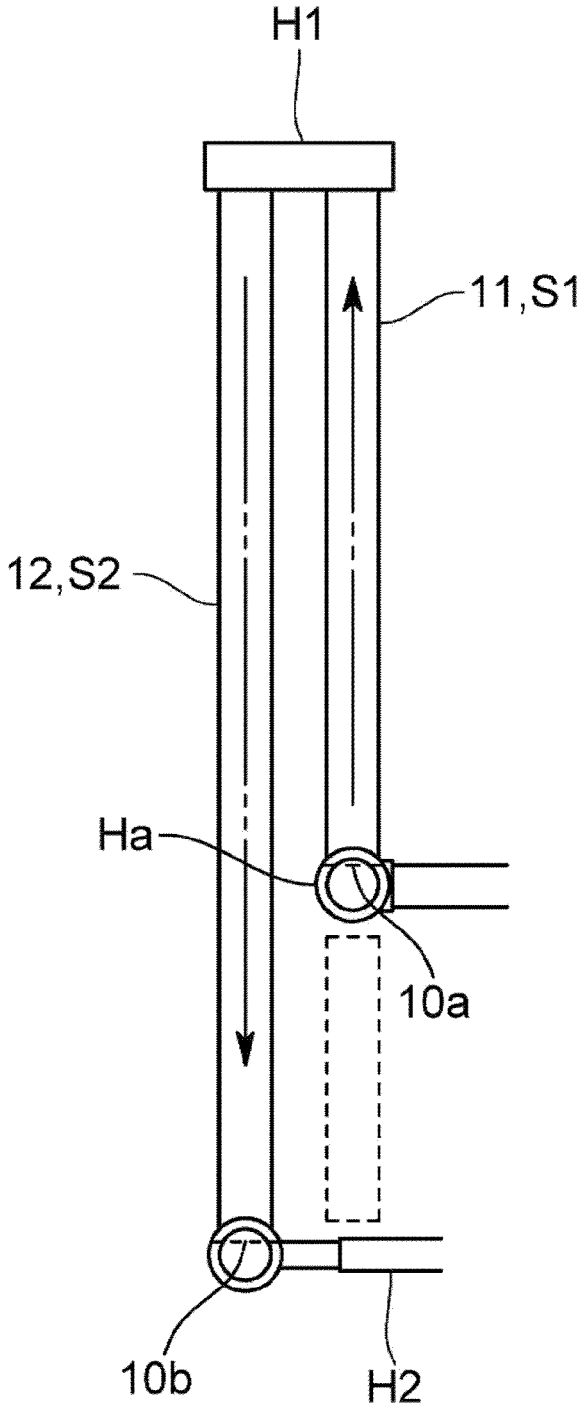
FIG. 9 is a view illustrating a configuration of a heat transfer tube according to another embodiment of the disclosure.
Figure 10A:
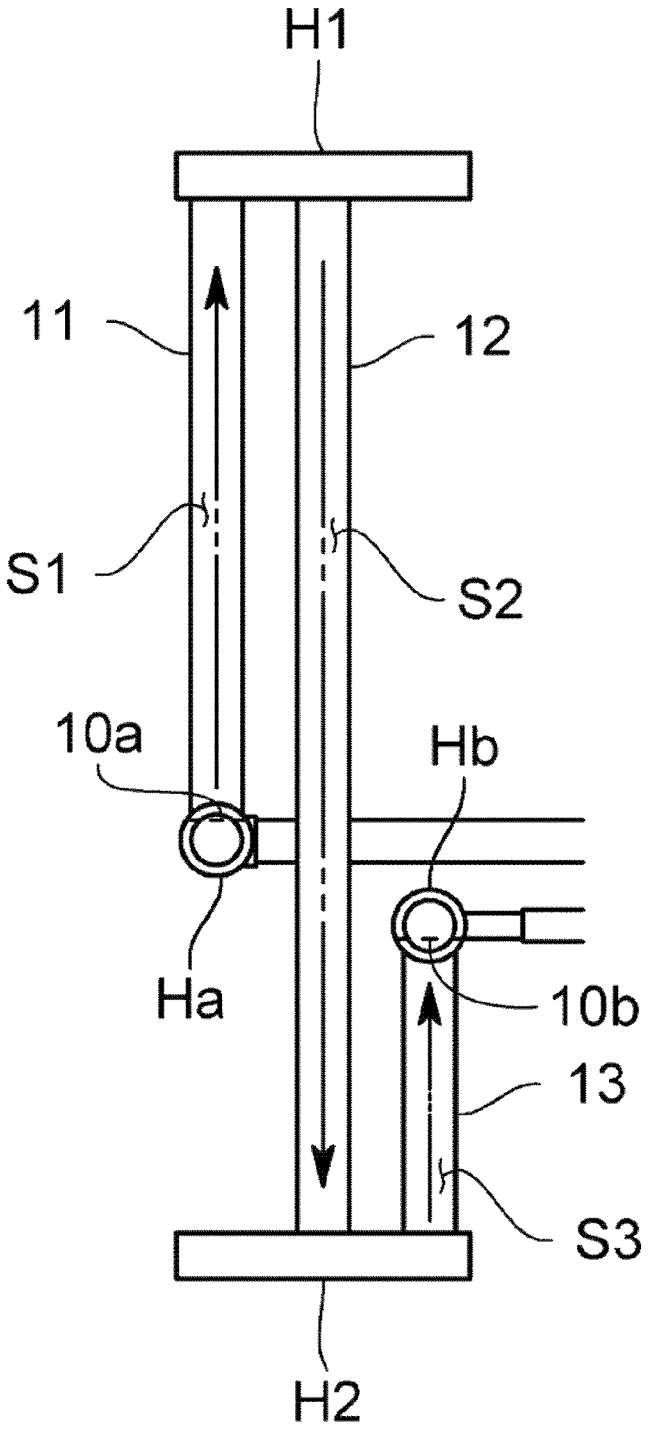
FIG. 10A is a view illustrating a configuration of a heat transfer tube according to another embodiment of the disclosure.
Figure 10B:
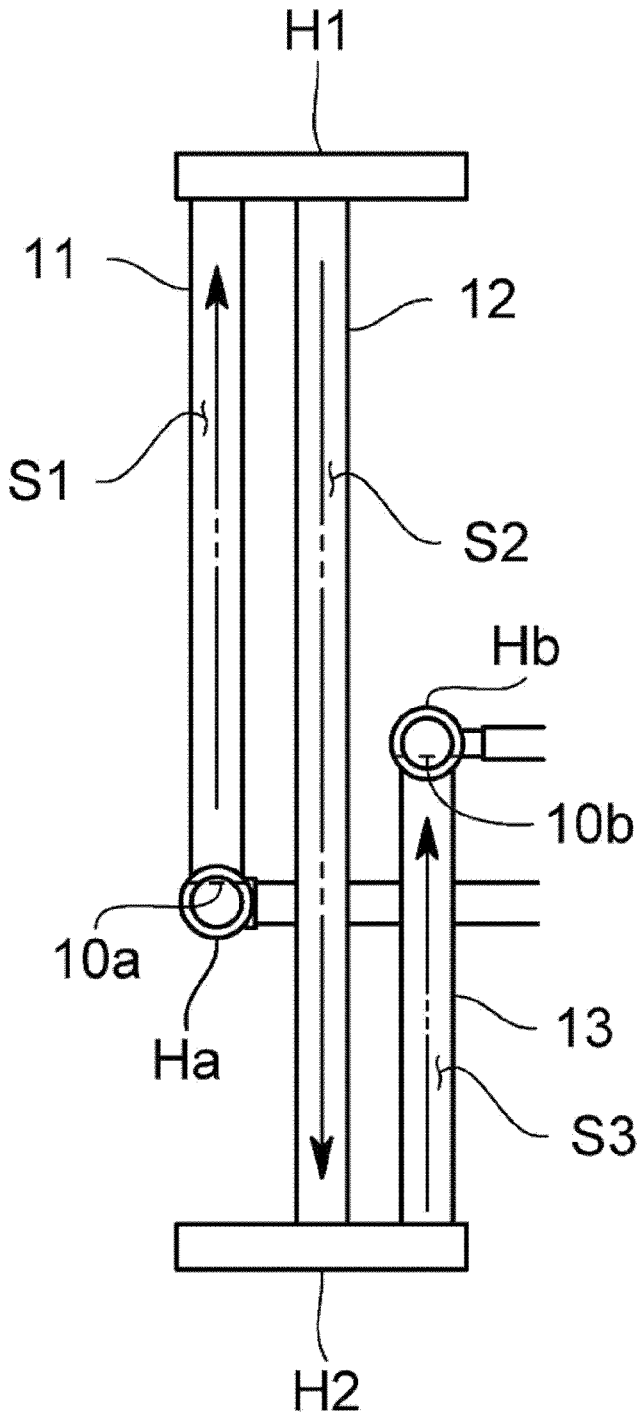
FIG. 10B is a view illustrating the configuration of the heat transfer tube according to another embodiment of the disclosure.
Figure 10C:
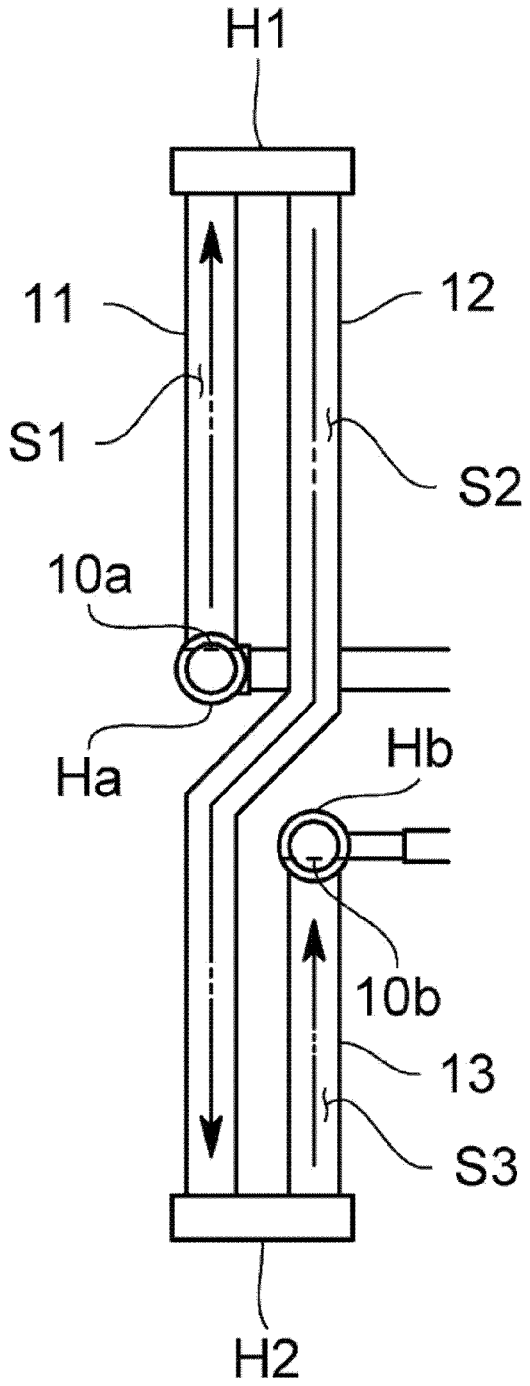
FIG. 10C is a view illustrating the configuration of the heat transfer tube according to another embodiment of the disclosure.
Figure 10D:
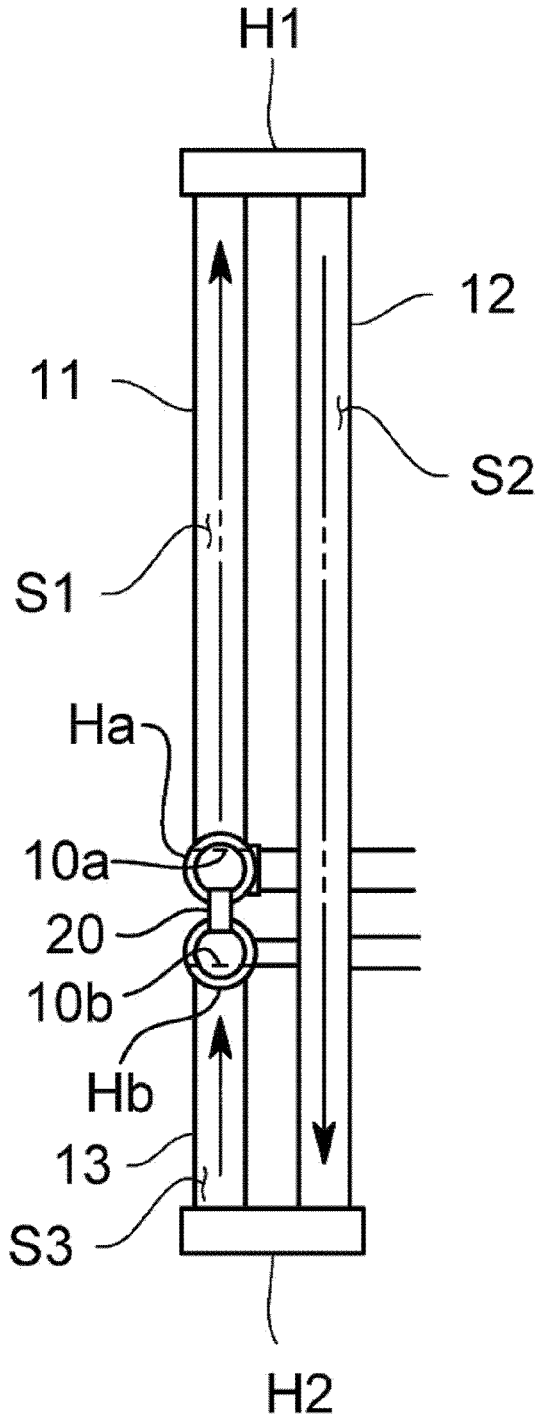
FIG. 10D is a view illustrating the configuration of the heat transfer tube according to another embodiment of the disclosure.
Figure 10E:
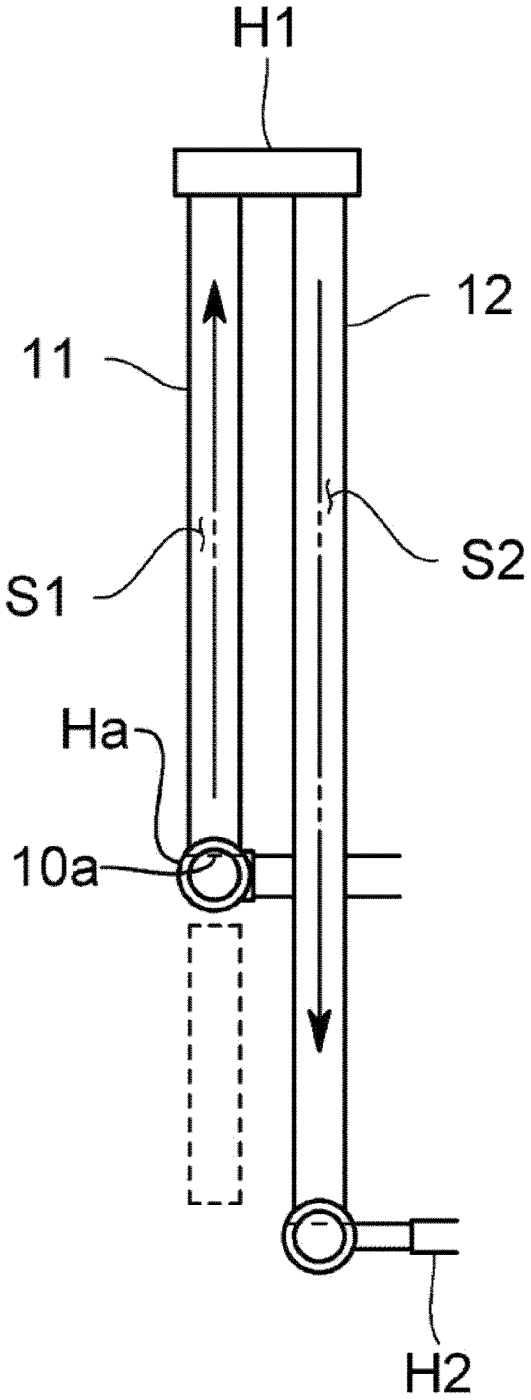
FIG. 10E is a view illustrating the configuration of the heat transfer tube according to another embodiment of the disclosure.

FIG. 9 illustrates a configuration in which the refrigerant outlet port 10*b* is disposed below the refrigerant inlet port 10*a*. Alternatively, the refrigerant outlet port 10*b* may be disposed at the same height as or higher than the refrigerant inlet port 10*a*.

In the above mentioned configuration, the liquid refrigerant flows downward in the two-phase refrigerant region S2 and is discharged through the refrigerant outlet port 10*b*, as the same manner as the embodiment. Further, because the gas refrigerant flows downward and then flows in the same direction as the liquid refrigerant in the two-phase refrigerant region S2, the gas refrigerant flows without pushing up the liquid refrigerant.

As a result, by configuring the refrigerant to flow in the vertical direction, it is possible to alleviate the difficulty related to the frost and the distribution device caused by the heat transfer tube 10 installed horizontally, and it is possible to prevent non-uniformity of the heat transfer region caused by the liquid refrigerant that is collected in the lower portion of the heat transfer tube 10.

Further, in the case of the heat exchanger 100, the liquid refrigerant region S3 may not be required in comparison the configuration of the above embodiment, and thus it is possible to reduce the cost as much as the cost of the liquid refrigerant region S3.

Figure 7C:
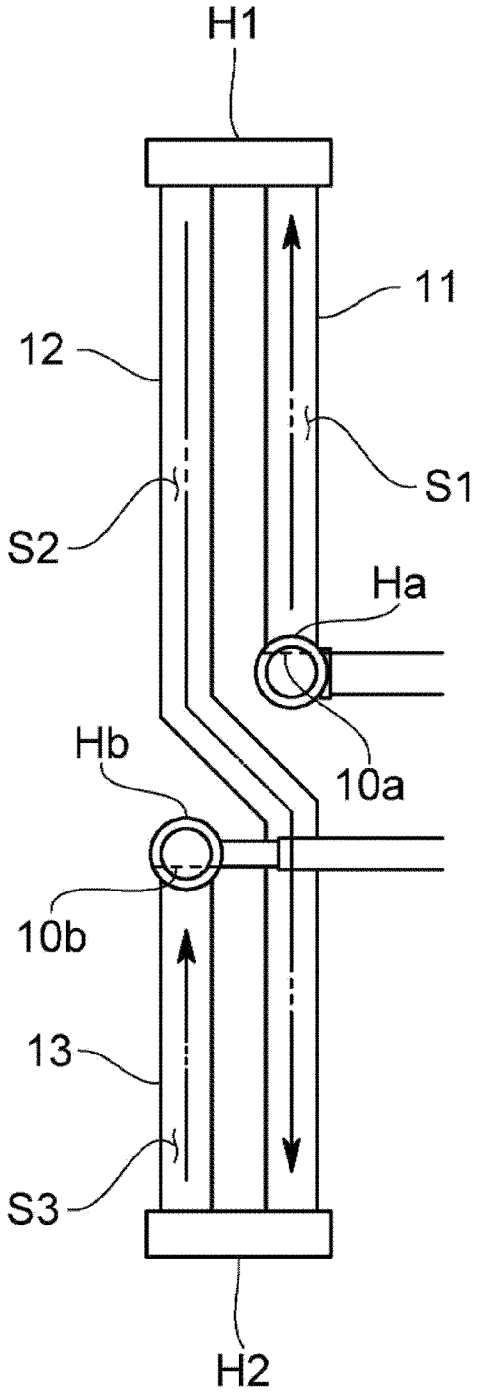
FIG. 7C is a view illustrating the configuration of the heat transfer tube according to another embodiment of the disclosure.

In addition, as shown in FIGS. 10A to 10E, the gas refrigerant region S1 may be disposed on the windward side than the two-phase refrigerant region S2 or the liquid refrigerant region S3. Particularly, the configuration of FIGS. 10A to 10E is an arrangement in which the gas refrigerant region S1 of the configuration shown in FIGS. 7, 8 and 9 is disposed on the windward side than the two-phase refrigerant region S2 or the liquid refrigerant region S3.

Hereinbefore the above-mentioned heat exchanger 100 is an example of the case where the heat exchanger 100 serves as a condenser, but the heat exchanger 100 according to the disclosure may serve as an evaporator, and in this case, the flow of the refrigerant is opposite to that described above.

Figure 11:
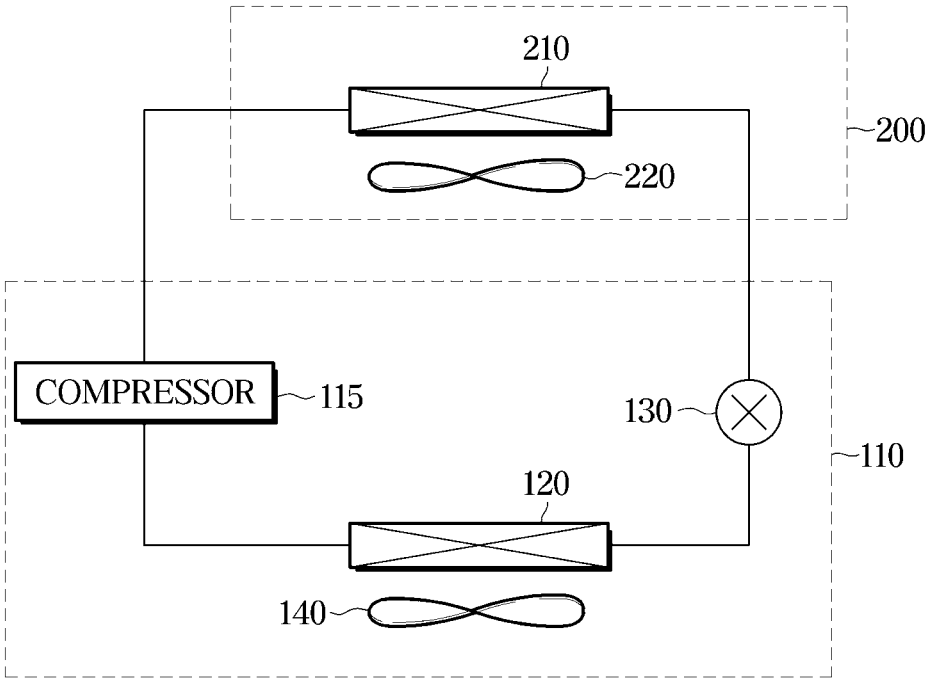
FIG. 11 is a view of an example of an air conditioner provided with the heat exchanger according to an embodiment of the disclosure.

As shown in FIG. 11, the heat exchanger 100 according to the embodiment may be applied to an outdoor heat exchanger 120 or an indoor heat exchanger 210 of the air conditioner provided with the refrigeration circuit to which a compressor 115, the outdoor heat exchanger 120, an expansion device 130, and the indoor heat exchanger 210 are connected.

The air conditioner may include an outdoor unit 110 and an indoor unit 200, and may perform a cooling operation for cooling the room or a heating operation for heating the room.

The outdoor unit 110 includes the compressor 115, the outdoor heat exchanger 120, the expansion device 130, and an outdoor fan 140, and the indoor unit 200 includes the indoor heat exchanger 210 and an indoor fan 220. A refrigerant tube through which a refrigerant is circulated may be connected between the outdoor unit 110 and the indoor unit 200.

The compressor 115 compresses the refrigerant and discharges the compressed high temperature and high pressure gas refrigerant to the outdoor heat exchanger 120. The outdoor heat exchanger 120 condenses the refrigerant by releasing heat from the refrigerant. In this case, the high temperature and high pressure gas refrigerant may be changed into a high temperature and high pressure liquid refrigerant.

The expansion device 130 lowers the pressure and temperature of the refrigerant introduced from the outdoor heat exchanger 120 to allow the heat absorption caused by evaporation of the refrigerant to easily occur, and then the expansion device 130 transfers the refrigerant to the indoor heat exchanger 210. That is, after passing through the expansion valve 130, the high-temperature and high-pressure liquid refrigerant is changed to the low-temperature and low-pressure liquid state.

The indoor heat exchanger 210 performs heat exchange with the room air by evaporating the refrigerant introduced from the expansion device 130. At this time, the low-temperature and low-pressure liquid refrigerant is changed into the low-temperature and low-pressure gas state.

When the above-described heat exchanger 100 severs as a condenser, the above-described heat exchanger 100 may serve as the outdoor heat exchanger 120.

When the above-described heat exchanger 100 severs as an evaporator, the above-described heat exchanger 100 may sever as the indoor heat exchanger 210, and in this case, the flow of the refrigerant may be opposite to that described above.

As is apparent from the above description, the heat exchanger may prevent non-uniformity of a heat transfer region caused by a liquid refrigerant that is collected in a lower portion of a heat transfer tube upon installing the heat transfer tube vertically.

Although a few embodiments of the disclosure have been shown and described, it would be appreciated by those skilled in the art that changes may be made in these embodiments without departing from the principles and spirit, of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. An air conditioner comprising:

a compressor;

an indoor heat exchanger;

an outdoor heat exchanger; and an expansion valve, wherein at least one of the indoor heat exchanger and the outdoor heat exchanger comprises:

a plurality of heat transfer tubes arranged in two rows to allow a refrigerant to flow in a vertical direction, an inlet header disposed in a first row and configured to introduce the refrigerant into the plurality of heat transfer tubes, an outlet header disposed in the first row below the inlet header and configured to discharge the refrigerant from the plurality of heat transfer tubes, an upper header arranged above the inlet header and the outlet header and configured to connect upper sides of the heat transfer tubes, and a lower header arranged below the inlet header and the outlet header and configured to connect lower sides of the heat transfer tubes, wherein each of the plurality of heat transfer tubes comprises:

a refrigerant inlet port disposed on the first row and connected to the inlet header between both ends of the inlet header in a longitudinal direction, a refrigerant outlet port disposed on the first row and connected to the outlet header between both ends of the outlet header in a longitudinal direction, a gas refrigerant region arranged in the first row and comprising a first end connected to the refrigerant inlet port and a second end connected to the upper header above the refrigerant inlet port;

a two-phase refrigerant region arranged in a second row and comprising a first end connected to the upper header and a second end connected to the lower header below the refrigerant inlet port; and a liquid refrigerant region arranged in the first row below with the gas refrigerant region and comprising a first end connected to the lower header and a second end connected to the refrigerant outlet port, wherein the refrigerant inlet port is disposed above the refrigerant outlet port in the first row, and wherein the first end of the two-phase refrigerant region connected to the upper header at the second row is disposed above the refrigerant inlet port in the first row and the refrigerant outlet port in the first row and the second end of the two-phase refrigerant region connected to the lower header at the second row is disposed below the refrigerant inlet port in the first row and the refrigerant outlet port in the first row.

2. The air conditioner of claim 1, wherein:

the refrigerant flows as a gas upward in the gas refrigerant region, the refrigerant flows as a gas-liquid two-phase refrigerant downward in the two-phase refrigerant region, and the refrigerant flows as a liquid upward in the liquid refrigerant region.

3. The air conditioner of claim 1, wherein a length of the gas refrigerant region is between 25% and 43% of a length of the plurality of heat transfer tubes from the refrigerant inlet port to the refrigerant outlet port.

4. The air conditioner of claim 1, wherein a length of the liquid refrigerant region is between 7% and 25% of a length of the plurality of heat transfer tubes from the refrigerant inlet port to the refrigerant outlet port.

5. The air conditioner of claim 1, wherein:

the two-phase refrigerant region is disposed on an upstream side of an air flow flowing between the heat transfer tubes, and the gas refrigerant region and the liquid refrigerant region are disposed on a downstream side of the air flow.

6. The air conditioner of claim 1, further comprising:

a first multi-bored flat tube in which the gas refrigerant region is formed;

a second multi-bored flat tube in which the two-phase refrigerant region is formed; and a third multi-bored flat tube in which the liquid refrigerant region is formed.

7. The air conditioner of claim 6, wherein:

the upper header is configured to connect the first multi-bored flat tube to the second multi-bored flat tube; and the lower header is configured to connect the second multi-bored flat tube to the third multi-bored flat tube.

8. The air conditioner of claim 7, wherein:

the plurality of heat transfer tubes are connected to the upper header and the lower header, and an inside of at least one of the upper header or the lower header is divided into a plurality of spaces to correspond to the plurality of heat transfer tubes.

9. The air conditioner of claim 1, further comprising a multi-bored flat tube in which the gas refrigerant region, the two-phase refrigerant region, and the liquid refrigerant region are formed.

10. The air conditioner of claim 9, wherein the multi-bored flat tube is bent in a C shape.

11. The air conditioner of claim 9, wherein a shape of each of the plurality of heat transfer tubes is different from each other in at least two of the gas refrigerant region, the two-phase refrigerant region, and the liquid refrigerant region.

12. The air conditioner of claim 11, wherein a volume of an internal flow path of each of the plurality of heat transfer tubes is reduced from the gas refrigerant region, the two-phase refrigerant region, and the liquid refrigerant region, in order.

13. The air conditioner of claim 1, further comprising a heat insulating material disposed at a gap between the inlet header and the outlet header.

14. A heat exchanger comprising:

a plurality of heat transfer tubes arranged in two rows to allow a refrigerant to flow in a vertical direction;

an inlet header disposed in a first row and configured to introduce the refrigerant into the plurality of heat transfer tubes;

an outlet header disposed in a first row below the inlet header and configured to discharge the refrigerant from the plurality of heat transfer tubes;

an upper header arranged above the inlet header and the outlet header and configured to connect upper sides of the heat transfer tubes; and a lower header arranged below the inlet header and the outlet header and configured to connect lower sides of the heat transfer tubes, wherein each of the plurality of heat transfer tubes comprises:

a refrigerant inlet port disposed on the first row and connected to the inlet header between both ends of the inlet header in a longitudinal direction, a refrigerant outlet port disposed on the first row and connected to the outlet header between both ends of the outlet header in a longitudinal direction, a gas refrigerant region arranged in the first row and comprising a first end connected to the refrigerant inlet port and a second end connected to the upper header above the refrigerant inlet port, a two-phase refrigerant region arranged in a second row and comprising a first end connected to the upper header and a second end connected to the lower header below the refrigerant inlet port, and a liquid refrigerant region arranged in the first row below with the gas refrigerant region and comprising a first end connected to the lower header and a second end connected to the refrigerant outlet port, wherein the refrigerant inlet port is disposed above the refrigerant outlet port in the first row, and wherein the first end of the two-phase refrigerant region connected to the upper header at the second row is disposed above the refrigerant inlet port in the first row and the refrigerant outlet port in the first row and the second end of the two-phase refrigerant region connected to the lower header at the second row is disposed below the refrigerant inlet port in the first row and the refrigerant outlet port in the first row.

15. The heat exchanger of claim 14, wherein:

the refrigerant flows as a gas upward in the gas refrigerant region, the refrigerant flows a gas-liquid two-phase refrigerant downward in the two-phase refrigerant region, and the refrigerant flows as a liquid upward in the liquid refrigerant region.

16. The heat exchanger of claim 14, wherein:

the two-phase refrigerant region is disposed on an upstream side of an air flow flowing between the heat transfer tubes, and the gas refrigerant region and the liquid refrigerant region are disposed on a downstream side of the air flow.

17. The heat exchanger of claim 14, further comprising:

a first multi-bored flat tube in which the gas refrigerant region is formed;

a second multi-bored flat tube in which the two-phase refrigerant region is formed; and a third multi-bored flat tube in which the liquid refrigerant region is formed.

18. The heat exchanger of claim 17, wherein:

the upper header is configured to connect the first multi-bored flat tube to the second multi-bored flat tube; and the lower header is configured to connect the second multi-bored flat tube to the third multi-bored flat tube.

19. The heat exchanger of claim 14, further comprising a multi-bored flat tube in which the gas refrigerant region, the two-phase refrigerant region and the liquid refrigerant region are formed.

20. The heat exchanger of claim 19, wherein the multi-bored flat tube is bent in a C shape.

* * * * *